United States Patent [19]

Vitt

[11] 4,139,924

[45] Feb. 20, 1979

[54] HINGE FITTING

[75] Inventor: Theodor Vitt, Porz-Eil, Fed. Rep. of Germany

[73] Assignee: G. Baumann & Co. Prameta Prazisionsmetaal- und Kunststofferzeugnisse, Cologne, Fed. Rep. of Germany

[21] Appl. No.: 853,412

[22] Filed: Nov. 21, 1977

[30] Foreign Application Priority Data

Dec. 18, 1976 [DE] Fed. Rep. of Germany ..... 2657576

[51] Int. Cl.[2] ..... E05D 11/10; E05D 5/02

[52] U.S. Cl. ..... 16/139; 16/158

[58] Field of Search ..... 16/139, 137, 143, 158

[56] References Cited

U.S. PATENT DOCUMENTS

| | | | |
|---|---|---|---|
| 3,488,792 | 1/1970 | Ashworth et al. | 16/158 |
| 4,069,549 | 1/1978 | Zernig et al. | 16/158 |

FOREIGN PATENT DOCUMENTS

| | | | |
|---|---|---|---|
| 2421871 | 11/1975 | Fed. Rep. of Germany | 16/158 |
| 304458 | 9/1968 | Sweden | 16/139 |

*Primary Examiner*—James Kee Chi

*Attorney, Agent, or Firm*—Diller, Ramik & Wight

[57] ABSTRACT

This disclosure is directed to a hinge fitting adapted to be secured to a leaf or frame and including a casing having a slot defined by a pair of spaced walls opening through interior and exterior surfaces of the casing, a locking member nonrotatably connected to a shaft which is in turn rotatably journaled to the casing and having an end portion with means for coupling a drive tool thereto for rotating the shaft to rotate the locking member to dispose a portion thereof beyond the casing and into gripping engagement with an associated leaf or frame. An axis of the shaft is disposed in eccentric relationship to the locking member and more closely adjacent one of the pair of spaced walls whereby the one wall serves as an abutment means to limit the outward disposition of the locking member beyond the casing.

13 Claims, 8 Drawing Figures

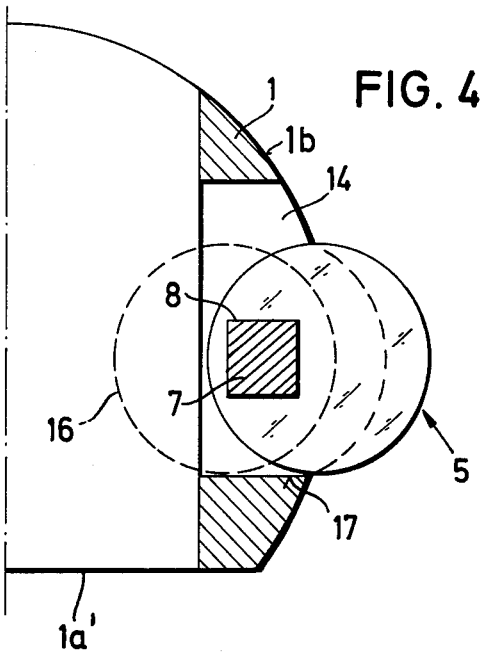
FIG. 4
FIG. 5
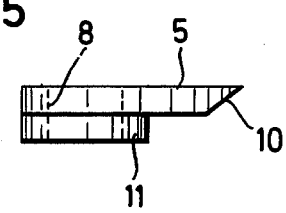
FIG. 7
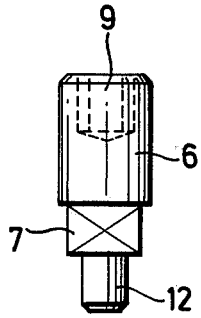
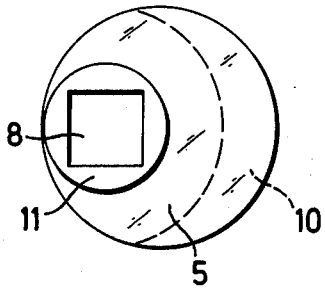
FIG. 6
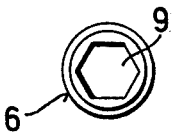
FIG. 8

HINGE FITTING

This invention is directed to a hinge fitting particularly adapted to be secured to a furniture leaf, door, or frame into which is adapted to be attached elements or components of a hinge, particularly of the type in which the hinge casing is of a pot-shaped configuration received in a like contoured bore of a leaf, door, or frame.

It is customary for hinges and particularly furniture hinges to utilize fittings or casings of a pot-shaped configuration. Such pot-shaped casings are inserted into a bore of the furniture frame, leaf and/or door which are generally made of wood, plastic, or similar material.

In order to secure the pot-shaped casings to its associated structural member it usually includes elements in the form of plates or projections which extend beyond the exterior periphery of the pot-shaped casing, are generally integrally cast therewith, and have apertures for receiving screws, bolts, or similar fastening devices. The difficulty with such pot-shaped casings are at a minimum two-fold, namely, the fact that the casing and projecting plates must be integrally cast and generally a minimum of three screws are utilized to fix the casing through the associated plates to a frame or leaf and the latter requires considerable work.

In lieu of the latter-described integral cast casings and projections, casings have been suggested absent the projections or plates and in lieu thereof locking tongues were arranged in the pot-shaped casing in a movable fashion to permit the locking tongues to be shifted externally of the casing to penetrate into the material of the frame, leaf or door. These locking tongues, as viewed in plan view, were pointed and in order to urge these pre-assembled locking tongues into the leaf, door or frame it was necessary to use a specialized tool. This tool was a pair of tongs which obviously is an additive expense and, moreover, once such locking tongues were locked in place, the tongues could not be returned to their unlocked position and thus it was not possible to reposition and/or remove a casing once installed, even by use of the latter-mentioned pair of tongs.

In keeping with the foregoing it is a primary object of this invention to provide a novel hinge casing or fitting in which one or more locking members or tongues are provided which can be displaced beyond an exterior peripheral surface of the casing in the absence of a special tool while at the same time permitting the locking members or tongues to be displaced to their inoperative position for relocation and/or reassembly purposes of the fitting or casing with an associated door, leaf or hinge.

In further accordance with this invention the novel hinge fitting includes a ridged connection between a locking shaft and at least one locking member or locking tongue, the latter connection including a polygonally shaped exterior surface portion of the shaft in interlocked relationship with a correspondingly shaped surface of an aperture of the locking member, and the shaft having an end portion with means for coupling a conventional drive dool thereto for rotating the shaft to move the locking member between lock and unlock positions in the absence of a special tool, the drive tool coupling means being in the form of a slot for the receipt of a conventional blade screw driver or having a recessed socket of a polygonal or star-shaped configuration to receive a conventional wrench as, for example, an Allen wrench.

In further keeping with this invention one or more of the locking members are formed as discs connected eccentrically to associated shafts with the disc shape permitting through its relatively large peripheral area safe and reliable securement to the frame or leaf by being relatively deeply imbedded therein.

Another object of this invention is to provide a novel hinge fitting of the type described wherein the disc-like locking member has a locking portion defining an acute angle in the form of a cutting edge for ease of imbedding into a leaf or frame, and preferably the disc-like locking member includes an annular reinforcing collar in part defining the polygonal shaped aperture receiving the shaft.

Another object of this invention is to provide a novel hinge fitting of the type heretofore set forth in which the axis of the shaft is not only eccentric relative to the locking member or locking disc but is also positioned closer to one of the pair of spaced walls than to the other whereby the one spaced wall serves as abutment means for limiting the outward projection of the locking member to achieve repetitive final locking positions of the locking member irrespective of frequent assembly and/or disassembly of the hinge fitting relative to frames or leaves.

In further accordance with this invention the exterior peripheral surface of the fitting generally includes at least one vertical rib which prevents the fitting or casing from being twisted in its associated bore upon rotation being imparted to the shaft.

With the above and other objects in view that will hereinafter appear, the nature of the invention will be more clearly understood by reference to the following detailed description, the appended claims and the several views illsutrated in the accompanying drawings.

IN THE DRAWINGS

FIG. 4 is a sectional view taken generally along line IV — IV of FIG. 3, and illustrates in phantom and solid outline the respective retracted unlocked and extended locked positions of one of a pair of locking members or tongues.

FIG. 5 is a side elevational view of the locking member, and illustrates a blade-like penetrating portion and a reinforcing collar.

FIG. 6 is a top plan view of the locking member and illustrates in detail the polygonal configuration of the aperture which interlocks with the shaft.

FIG. 7 is an elevational view of the shaft and illustrates the details thereof including a recessed polygonally shaped bore for receiving a conventional Allen or like wrench.

FIG. 8 is a top plan view of the shaft of FIG. 7 and illustrates more specifically the polygonal configuration of the bore.

Figure 1:
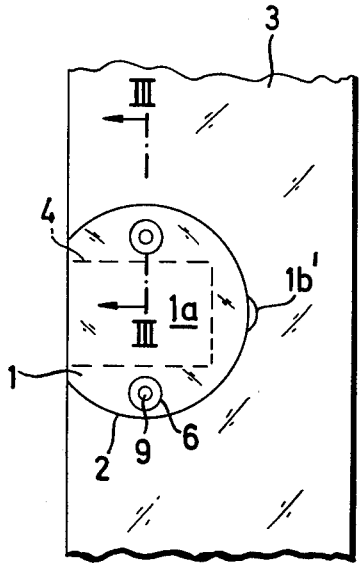
FIG. 1 is a fragmentary elevational view of a leaf, door or frame and illustrates a hinge fitting received in a bore and having exposed shaft end portions for rotating associated locking members.

A novel hinge fitting adapted to be secured to a leaf or frame is fully illustrated in FIGS. 1 through 4 of the drawings and is generally designated by the reference numeral 1. The hinge fitting or casing 1 is of a pot-shaped configuation which is received in a recess or bore 2 of a door, leaf or frame 3 of a piece of furniture.

Figure 2:
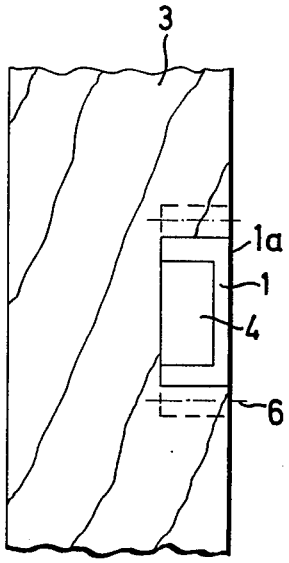
FIG. 2 is a similar view looking from left-to-right in FIG. 1 and illustrates a recess in the hinge fitting adapted to receive hinge components for uniting the fitting to another fitting of a leaf or frame.

The hinge fitting or casing 1 includes an uppermost generally planar surface 1*a* which is adapted to lie flush with a surface (unnumbered) of the frame or leaf 3 in a manner clearly illustrated in FIG. 2. The casing or fitting 1 further includes an exterior peripheral surface 1*b* and an interior surface 1*c* (FIG. 3), the latter of which in part defines an internal recess or chamber 4 which is adapted to receive hinge elements or joints in a conventional manner which are connected to another hinge fitting (not shown). The exterior peripheral surface 1*b* of the casing or fitting 1 also includes a generally vertical rib 1*b*′ (FIG. 1) which precludes rotation of the casing 1 upon rotation being imparted to a disc or locking member or locking tongue 5 through an associated shaft 6.

The shaft 6 includes an upper cylindrical portion (unnumbered), a medial portion 7 of a generally polygonally or rectangularly shaped cross section (FIG. 4) and a lower cylindrical portion 12 journaled for rotation in a cylindrical bore 13 of the casing 1. The polygonally shaped portion 7 of the shaft 8 is in interlocked relationship with a like contoured polygonally shaped aperture or bore 8 (FIGS. 4 and 6) of the locking member 5 and a projecting annular collar 11 of the latter. Means 9 in the form of a polygonally shaped upwardly opening recess are provided in the cylindrical upper portion (unnumbered) of the shaft 6 to receive a conventional tool (Allen wrench) for rotating the shaft 6 and imparting rotation to the locking member 5 to move the same from its inoperative or phantom outline position 16 in FIG. 4 to its operative solid outline position shown in the same figure.

Figure 3:
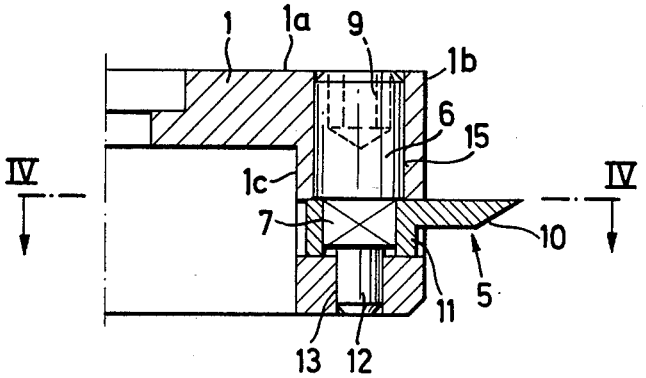
FIG. 3 is an enlarged cross-sectional view taken generally along line III — III of FIG. 1, and illustrates details of the shaft and locking member including a polygonal interconnection between the shaft and a like contoured aperture of the locking member.

The locking member 5 includes a peripheral edge portion 10 whose upper and lower unnumbered surfaces as viewed in FIG. 3 define a generally acute angle therebetween with the uppermost surface of the locking member 5 being generally parallel to the outer surface 1*a* of the casing 1. The acute nature of the peripheral edge portion 10 serves as a blade or knife edge which will progressively bite or cut into the wood of the frame, leaf or door 3 as the shaft 6 is rotated and once fully projected beyond the peripheral surface 1*b* the hinge fitting 1 is rigidly retained in the leaf, door or frame 3.

Reference is made to FIG. 4 wherein a slot 14 is fully illustrated and extends between the outer peripheral surface 1*b* and the inner surface 1*c* of the casing 1 as further defined by opposite walls, only one of which is indicated by the reference numeral 17. The recess 14 along with the interior of the recess 14 houses the locking member 5 when in the inoperative position shown in FIG. 4, as is indicated by the reference numeral 16. In the operative position of the locking member 5 which is shown in solid outline in FIG. 4 a portion of the locking member 5 projected beyond the exterior periheral surface 1*b* and more importantly a peripheral edge (unnumbered) of the locking member 5 contacts the wall 17 which serves as abutment means for limiting not only the maximum outward projection of the locking member 5 beyond the recess 14, but also the maximum inward projection of the locking member 5, again is shown in phantom outline and designated by the reference numeral 16 in FIG. 4.

It is also to be noted from FIG. 4 that the axis of the shaft 6 is closer to the wall or abutment means 17 and the opposite unnumbered wall parallel thereto. This permits the locking member to freely move through the recess 14 pass the unnumbered wall opposite the wall 17 when the shaft is rotated to rotate the locking member from the phantom to the solid or from the solid to the phantom outline positions of FIG. 4 while at the same time making certain that the locking member 5 will contact the wall or abutment means 17 in the maximum extended and maximum retracted positions, again shown in solid and phantom outlines, respectively, in FIG. 4. Of course, the axis of the shaft 6 is coincident with the axis of the bore 13 and a bore 15 receiving the upper enlarged cylindrical portion (unnumbered) of the shaft 6 (FIG. 3).

It is also to be noted from FIG. 4 of the drawings that the casing 1 includes a flat surface 1*a*′. The eccentric axis of the shaft 6, the end portion 12, and the bores 13, 15 are provided so that the sense of rotation of the locking member 5 is preformed in a direction toward the flat surface or face 1*a*′ of the hinge fitting or casing 1 so that reaction forces are received at the side (unnumbered) of the casing 1 opposite to the flat surface 1*a*′ in the bore 2 of the frame, leaf or door 3.

The hinge fitting or casing 1 is preferably constructed as a one-piece zinc or plastic dye casting while the locking member or locking disc 5 is preferably constructed of steel.

Although only a preferred embodiment of the invention has been specifically illustrated and described herein, it is to be understood that minor variations may be made [in the apparatus or in the method of] without departing from the spirit and scope of the invention, as defined in the appended claims.

I claim:

1. A hinge fitting adapted to be secured to a leaf or frame comprising a casing having an exterior peripheral surface including a face adapted to be disposed generally flush with a leaf or frame surface, a circular locking member, a shaft, means nonrotatably connecting said shaft in eccentric relationship to said locking member, means rotatably connecting said shaft to said casing whereby a portion of said locking member is adapted to be disposed beyond said exterior peripheral surface for locking engagement with a leaf or frame, said shaft having an end portion with means for coupling a drive tool thereto for rotating said shaft, a recess in said casing opening through said peripheral surface into and out from which said locking member portion may pass, said recess being of a predetermined length as measured generally normal to said face, and said rotatable connecting means being disposed other than medially of said predetermined length.

2. The hinge as defined in claim 1 wherein said nonrotatable connecting means includes a polygonally shaped exterior surface portion of said shaft in interlocked relationship with a correspondingly shaped surface of an aperture of said locking member.

3. The hinge as defined in claim 1 wherein said casing has an outer surface adapted to be disposed flush with a surface of a leaf or frame, and said locking member portion having first and second surfaces defining an acute angled cross section of said locking member portion.

4. The hinge as defined in claim 1 wherein said casing has an outer surface adapted to be disposed flush with a surface of a leaf or frame, said locking member portion having first and second surfaces defining an acute angled cross section of said locking member, said first surface being generally parallel to said casing outer surface and more adjacent thereto than said second surface, and said second surface defining an acute angle with both said first surface and said outer surface.

5. The hinge as defined in claim 1 wherein said casing has an outer surface adapted to be disposed flush with a surface of a leaf or frame, said locking member portion having first and second surfaces defining an acute angled cross section of said locking member, said first surface being generally parallel to said casing outer surface and more adjacent thereto than said second surface, said second surface defining an acute angle with both said first surface and said outer surface, and said locking member includes an annular projecting collar receiving said shaft.

6. The hinge as defined in claim 1 wherein said casing includes abutment surface means against which said locking member abuts for limiting the outward disposition of said locking member beyond said exterior peripheral surface.

7. The hinge as defined in claim 1 wherein said casing has an outer surface adapted to be disposed flush with a surface of a leaf or frame, and said exterior peripheral surface is interrupted by a rib disposed generally transverse to said outer surface for interlocking with a leaf or frame to prevent rotation of said casing upon rotation being imparted to said shaft.

8. The hinge as defined in claim 2 wherein said casing includes abutment surface means against which said locking member abuts for limiting the outward disposition of said locking member beyond said exterior peripheral surface.

9. The hinge as defined in claim 8 wherein said casing includes an interior surface, a slot in said casing extending between said exterior peripheral surface and said interior surface, said slot further being defined by a pair of spaced walls extending between said exterior peripheral surface and said interior surface, an axis of said shaft being more closely adjacent one of said pair of spaced walls than another of said spaced walls, and said one spaced wall defines said abutment surface means.

10. The hinge as defined in claim 1 wherein said predetermined length is established by a pair of spaced parallel walls which are parallel to said face.

11. The hinge as defined in claim 10 wherein said casing further includes inner and outer surfaces between which is disposed said exterior peripheral surface, said locking member having an annular collar projecting toward said inner surface, said nonrotatable connecting means includes a polygonally shaped exterior surface portion of said shaft in interlocked relationship with a correspondingly shaped surface of an aperture in said annular collar, and said locking member portion having first and second surfaces defining an acute angled cross section.

12. The hinge as defined in claim 10 wherein said casing further includes inner and outer surfaces between which is disposed said exterior peripheral surface, said shaft being housed entirely between said inner and outer surfaces, and said drive tool coupling means is carried by the end portion of said shaft most adjacent said outer surface.

13. The hinge as defined in claim 11 wherein said locking member first surface is adjacent and parallel to said casing outer surface, said shaft being housed entirely between said inner and outer surfaces, said drive tool coupling means being carried by the end poriton of said shaft most adjacent said outer surface, and said aperture surface is also located in said locking member.

* * * * *

UNITED STATES PATENT AND TRADEMARK OFFICE

CERTIFICATE OF CORRECTION

PATENT NO. : 4,139,924

DATED : February 20,1979

INVENTOR(S) : Theodor Vitt

It is certified that error appears in the above-identified patent and that said Letters Patent are hereby corrected as shown below:

On the title page kindly correct the assignee to read:

---[73] Assignee: Prämeta Präzisionsmetall- und Kunststofferzeugnisse G. Baumann & Co. of Cologne, West Germany---

Signed and Sealed this

*Thirty-first* Day of *July 1979*

[SEAL]

*Attest:*

*Attesting Officer*

LUTRELLE F. PARKER

*Acting Commissioner of Patents and Trademarks*